US006098718A

United States Patent [19]

Sato

[11] Patent Number: 6,098,718

[45] Date of Patent: Aug. 8, 2000

[54] HORIZONTAL SIDEWALL SPRINKLER HEAD

[75] Inventor: Koki Sato, Tokyo, Japan

[73] Assignee: Senju Sprinkler Company Limited, Tokyo, Japan

[21] Appl. No.: 09/203,382

[22] Filed: Dec. 2, 1998

[30] Foreign Application Priority Data

| | | | |
|---|---|---|---|
| Dec. 3, 1997 | [JP] | Japan | 9-347351 |
| Dec. 3, 1997 | [JP] | Japan | 9-347352 |
| Dec. 3, 1997 | [JP] | Japan | 9-347353 |

[51] Int. Cl.[7] ..... A62C 37/08

[52] U.S. Cl. ..... 169/37; 239/208; 239/209; 239/498; 239/524

[58] Field of Search ..... 239/209, 498, 239/504, 524, 518; 169/37, 42, 57

[56] References Cited

U.S. PATENT DOCUMENTS

| | | | |
|---|---|---|---|
| 4,296,815 | 10/1981 | Mears | 169/37 |
| 4,296,816 | 10/1981 | Fischer . | |
| 4,616,710 | 10/1986 | Pilant et al. | 169/37 |
| 5,722,599 | 3/1998 | Fries . | |
| 5,727,737 | 3/1998 | Bosio . | |

FOREIGN PATENT DOCUMENTS

| | | |
|---|---|---|
| 52-106000 | 8/1977 | Japan . |
| 55-30175 | 2/1980 | Japan . |
| 64-5570 | 1/1989 | Japan . |
| 5-24058 | 3/1993 | Japan . |

*Primary Examiner*—Kevin Shaver
*Assistant Examiner*—David Deal
*Attorney, Agent, or Firm*—Wenderoth, Lind & Ponack, L.L.P.

[57] ABSTRACT

A horizontal sidewall sprinkler head includes a tubular body with an inlet end adapted to be connected to a source of fire extinguishing liquid, and an opposite, discharge end. The tubular body includes an internal passage extending axially therethrough. The tubular body has an axis extending centrally through the internal passage. A deflector is supported from the tubular body. The deflector includes a plurality of sets of mirror image side tines extending in a direction transverse to the axis of the tubular body. At least one set of side tines are rearwardly angled and diverge from the axis of the tubular body in a direction toward the discharge end of the tubular body. An auxiliary deflector is secured to the tubular body and includes a canopy portion. The canopy portion is located above the primary deflector and inclined downwardly with respect to the axis of the tubular body.

23 Claims, 10 Drawing Sheets

HORIZONTAL SIDEWALL SPRINKLER HEAD

BACKGROUND OF THE INVENTION

The present invention relates to horizontal sidewall sprinkler heads and sprinkler deflectors for producing a spray pattern of water or other fire extinguishing liquid.

Horizontal sidewall sprinkler heads are mounted on the vertical walls of a building or a room, typically at a location near the ceiling. A typical horizontal sprinkler head is disclosed in U.S. Pat. No. 5,727,737 issued to Bosio et al. The prior art horizontal sprinkler head includes a tubular sprinkler body with an inlet end and a discharge end, and a frame consisting of two spaced arms joined to a boss. A deflector includes a vertical portion affixed to the boss and a canopy portion disposed above the vertical portion. In order to distribute fire extinguishing liquid against the wall in which the sprinkler head is mounted, a pair of tabs are bent rearwardly from the vertical portion and converge toward the discharge end of the sprinkler body. However, with the converging tabs, opposite lateral sides of the region beneath the sprinkler head tend to be left uncovered. Also, in order to direct liquid toward a remote region of the area to be protected, the canopy portion of the deflector is inclined upwardly at a small angle with respect to the axis of a sprinkler passage. The upwardly angled canopy portion, however, causes liquid to be directed undesirably beyond the remote region of the area to be protected. This results in opposite lateral sides of the remote region being left uncovered.

Japanese laid-open utility model publication No. 5-24058 discloses a sprinkler body, and a cylindrical frame to which a circular deflector is attached. The deflector includes a plurality of radial slots to provide a plurality of radial tines. An auxiliary deflector extends horizontally forwardly from the frame and has a semicylindrical shape. However, the radial tines causes lateral sides of the region beneath the sprinkler head to be left uncovered. Moreover, the horizontal auxiliary deflector causes fire extinguishing liquid to be directed undesirably beyond a remote region of the area to be protected (see FIG. 12).

Accordingly, it is an object of the present invention to provide a horizontal sidewall sprinkler head which provides uniform distribution of water or other fire extinguishing liquid over the area to be protected.

It is another object of the present invention to provide a deflector for use in a horizontal sidewall sprinkler head, which assures optimum distribution of fire extinguishing liquid across the region immediately beneath the sprinkler head as well as the wall in which the sprinkler head is mounted.

SUMMARY OF THE INVENTION

According to one aspect of the present invention, there is provided a horizontal sidewall sprinkler head comprising a tubular body having an inlet end adapted to be connected to a source of fire extinguishing liquid, and a discharge end. The tubular body includes an internal passage extending axially therethrough. The tubular body has an axis extending generally centrally through the internal passage. A deflector is supported from the tubular body and includes a plurality of sets of tines extending in a direction transverse to the axis of the tubular body. As a feature, at least one set of tines are rearwardly bent, preferably at an angle in the range from 10° to 30°, more desirably 15° to 25°, and diverge from the axis of the tubular body in a direction toward the discharge end of the tubular body.

In a preferred embodiment, an auxiliary deflector is secured to the tubular body and includes a canopy portion located above the primary deflector and downwardly angled with respect to the axis of the tubular body. The primary deflector has at its top a notch through which fire extinguishing liquid flows and is directed to the auxiliary deflector. The canopy portion of the auxiliary deflector is preferably inclined downwardly at an angle of 1° to 30° with respect to the axis of the tubular body. The top notch may have an arcuate or triangular shape.

In another preferred embodiment, an auxiliary deflector is operatively associated with the deflector and includes an upright portion having one end secured to the tubular body, and a canopy portion located above the deflector and extending forwardly from the other end of the upright portion. The canopy portion has a downwardly bent free end. The primary deflector has at its top a notch through which fire extinguishing liquid flows and is directed to the bent end of the auxiliary deflector. The bent end of the canopy portion is preferably inclined downwardly at an angle of 1° to 30° with respect to the axis of the tubular body. The bent end of the canopy portion may be located forwardly of the primary deflector.

According to another aspect of the present invention, there is provided a deflector adapted for use in a horizontal sidewall sprinkler head with a tubular body, which comprises a plurality of sets of side tines, at least one set of which are rearwardly angled and diverge toward the discharge end of the tubular body.

The above and other objects, features and advantages of the present invention will become apparent from a reading of the following detailed description of the invention, when taken in conjunction with the accompanying drawings.

DETAILED DESCRIPTION OF THE INVENTION

Figure 1:
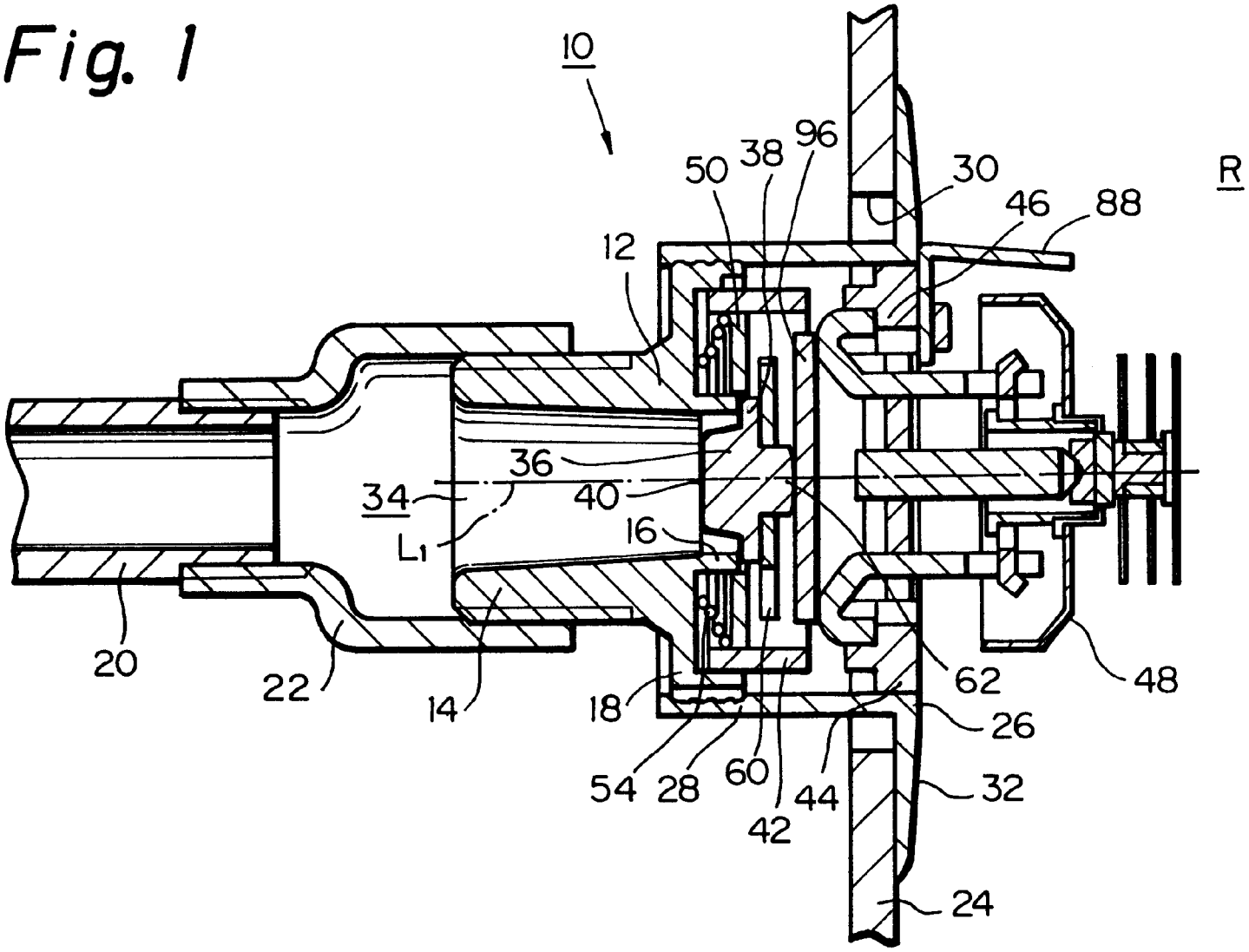
FIG. 1 is a longitudinal sectional view of a horizontal sidewall sprinkler head made according to one embodiment of the present invention and installed on one vertical sidewall of a rectangular room.
Figure 2:
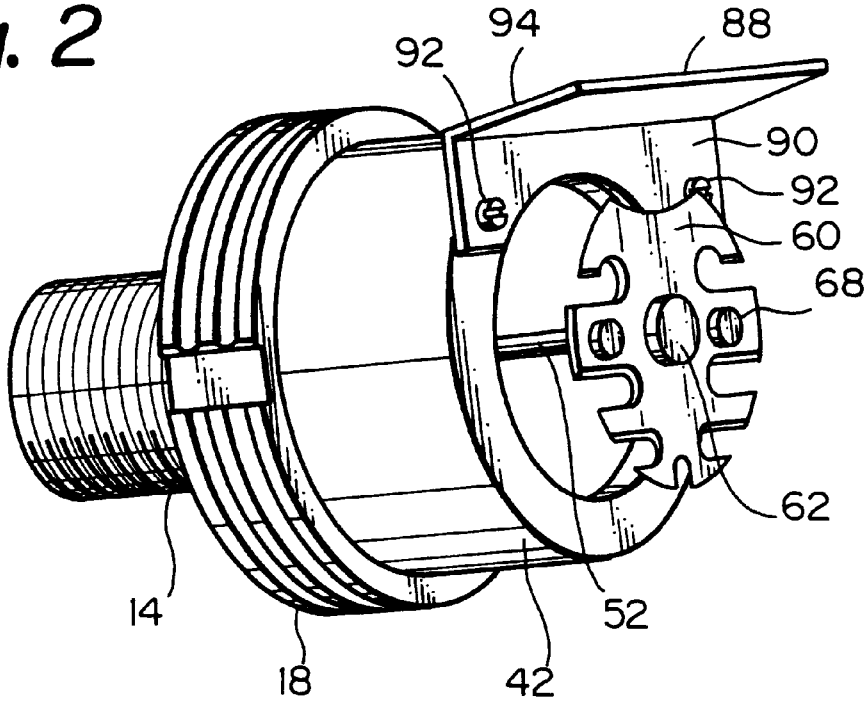
FIG. 2 is a perspective view of the sprinkler head as shown in FIG. 1.
Figure 3:
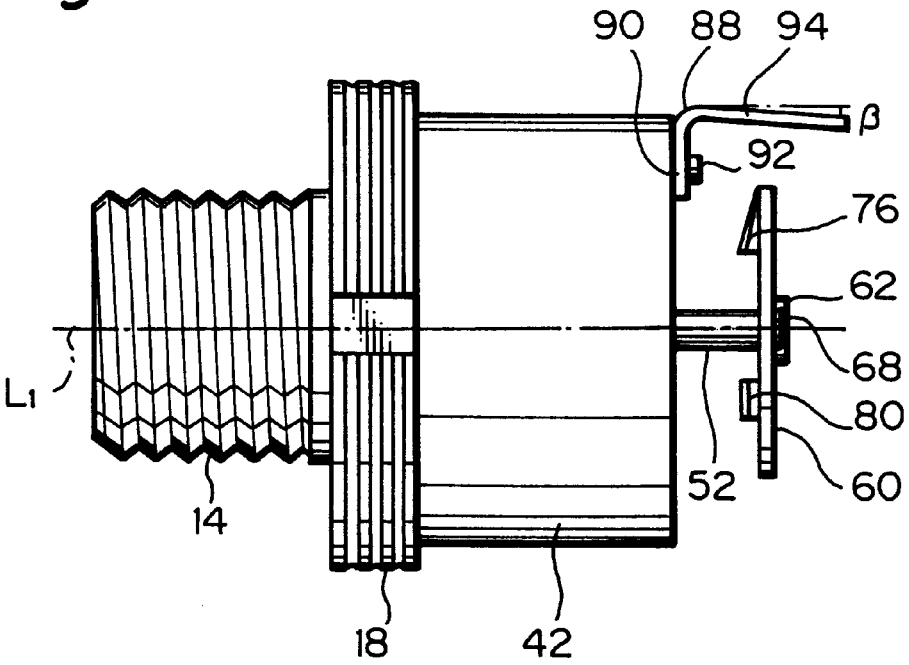
FIG. 3 is a side view of the sprinkler head as shown in FIG. 1.

Referring now to FIGS. 1 to 3, there is illustrated a flush horizontal sidewall sprinkler head made according to one embodiment of the present invention and generally designated at 10. The sprinkler head 10 includes an externally threaded tubular body 12 with an inlet end 14 and an opposite, discharge end 16, and an externally threaded cylindrical end flange 18 extending outwardly from the discharge end 16 of the body 12. The inlet end 14 of the tubular body 12 is fluidly connected to a water supply line through an internally threaded fitting 22. The sprinkler head 10 is installed near the top of a vertical sidewall 24 of a rectangular room R through a mount 26. The mount 26 is in the form of a skirt and includes an internally threaded sleeve 28 threadably secured around the end flange 18 of the sprinkler head 10 and extending through an opening 30 of the sidewall 24, and an outwardly extending annular flange 32 placed in close contact with the sidewall 24 of the room R. The tubular body 12 includes an internal passage 34 which extends between the inlet end 14 and the discharge end 16 of the tubular body and is communicated with the water supply line 20. The tubular body 12 has an axis $L_1$ which extends substantially centrally through the internal passage 34. The discharge end 16 of the tubular body 12 serves as a valve seat for a valve element 36. The valve element 36 is generally cylindrical in shape and includes an outwardly extending annular flange 38 which normally seats against the discharge end 16 of the tubular body 12. A suitable gasket 40 is attached to the bottom of the valve element 36 to seal the discharge end 16 of the tubular body 12.

Figure 5:
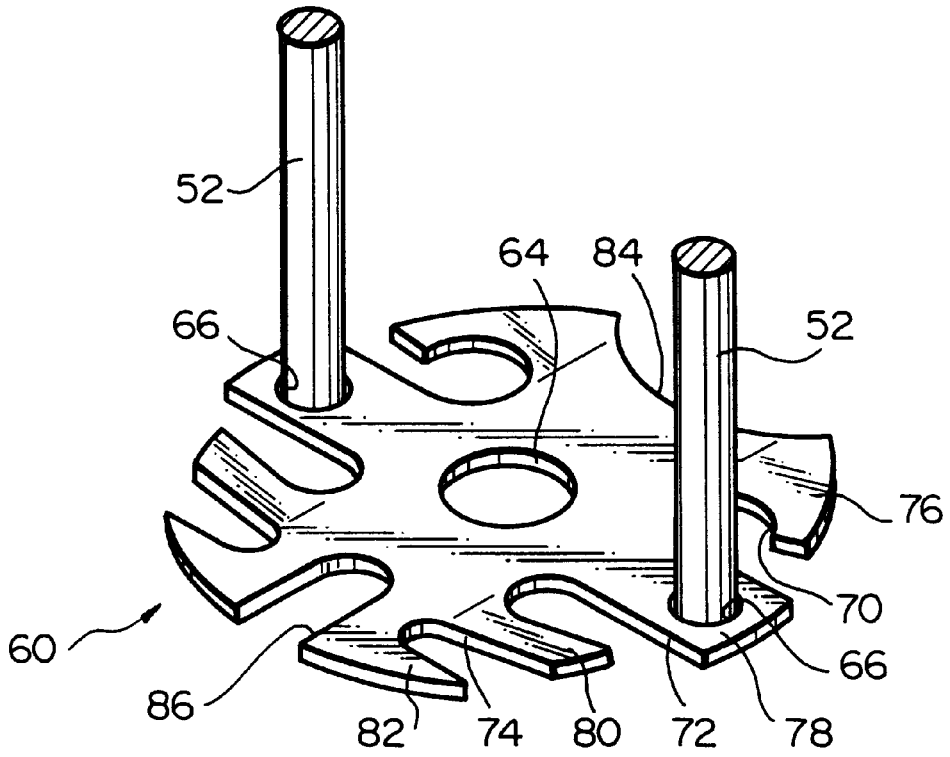
FIG. 5 is a an enlarged perspective view of the deflector.

A cylindrical frame 42 is secured to the end flange 18 and surrounded by the sleeve 28 of the mount 26. The frame 42 includes an outwardly extending annular flange 44 placed in contact with the inner peripheral surface of the sleeve 28, and an inwardly extending annular flange 46 adapted to mount a thermally responsive assembly 48 thereto. A ring 50 is normally placed around the discharge end 16 of the tubular body 12 within the frame 42. As best shown in FIG. 5, a pair of diametrically opposite struts 52, 52 extend perpendicularly from one side of the ring 50. A compression spring 54 is disposed between the other side of the ring 50 and the bottom of the end flange 18 of the sprinkler head 10.

Figure 4:
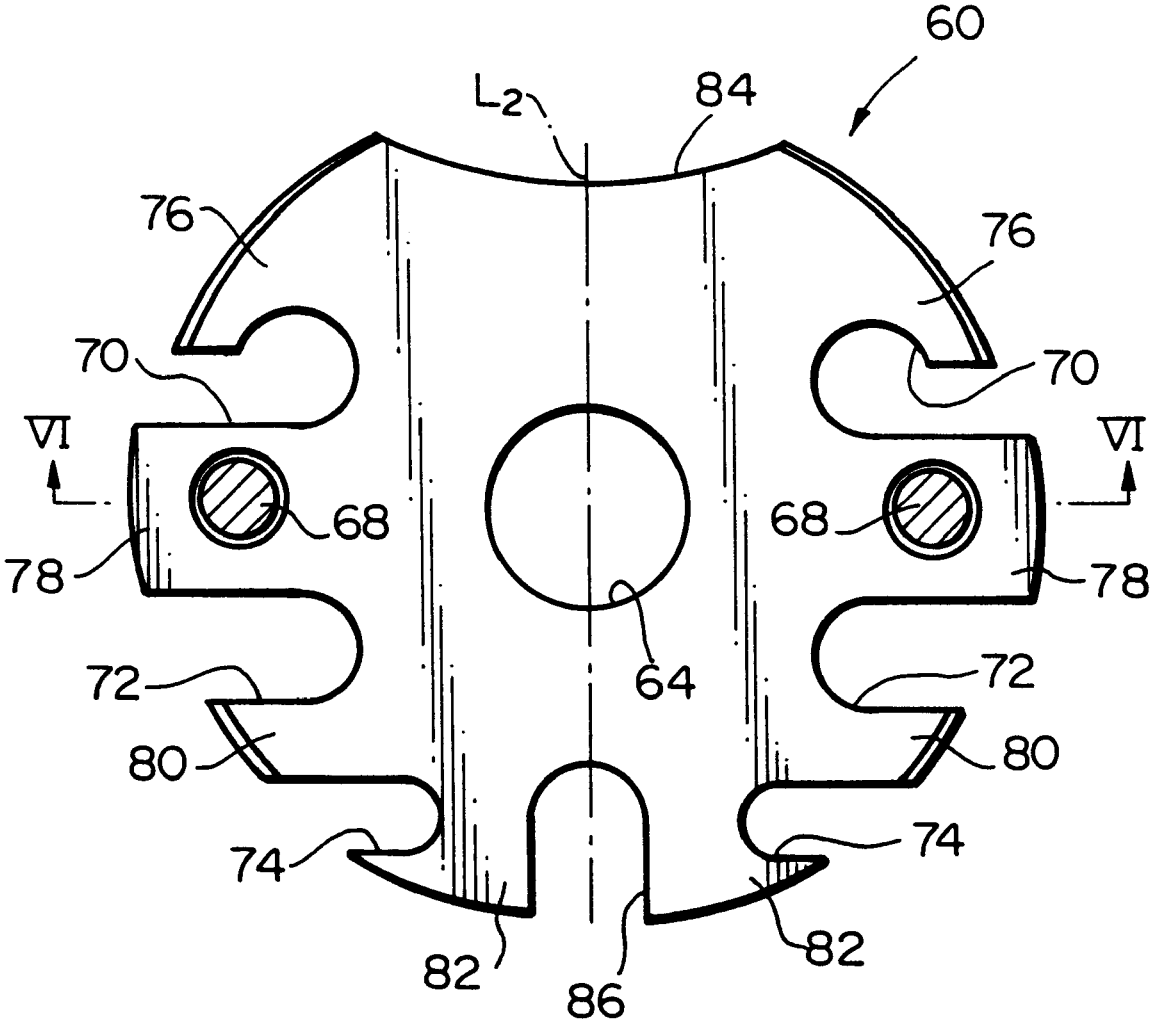
FIG. 4 is an enlarged front view of a deflector incorporated within the sprinkler head.
Figure 6:
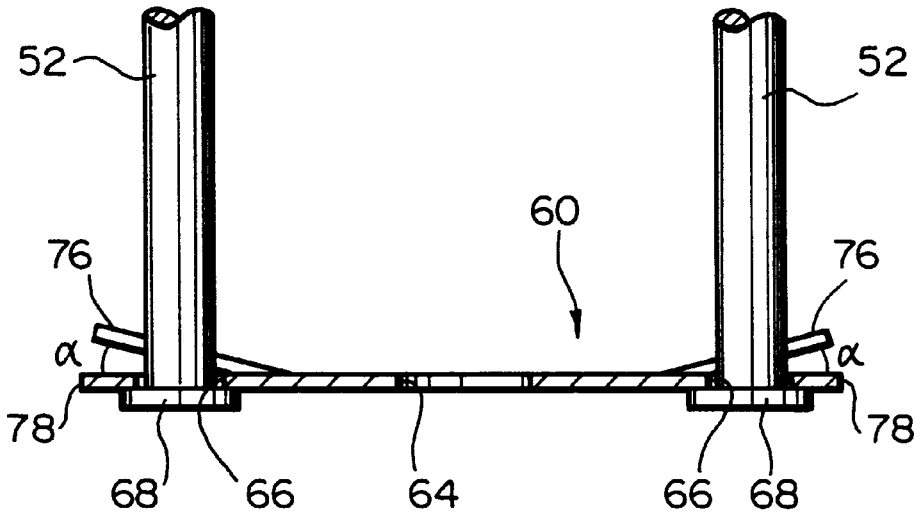
FIG. 6 is a sectional view taken on line VI—VI in FIG. 4 to show that a plurality of diverging tines are rearwardly angled relative to an imaginary vertical plane.

As best shown in FIG. 4, a deflector 60 is in the form of a generally circular disc and is laterally symmetrical with respect to an imaginary vertical line $L_2$. The vertical line $L_2$ extends in a direction perpendicular to the axis $L_1$ of the tubular body 12. The valve element 36 includes a projection 62 as shown in FIGS. 2 and 3. The deflector 60 includes a central opening 64 through which the deflector 60 is snugly fitted over the projection 62. The deflector 60 includes diametrically opposite circular openings 66, 66 through which the respective struts 52, 52 extend. The struts 52, 52 have enlarged flat ends 68, 68 which serve as stoppers for the deflector 60. The deflector 60 is moved along and guided by the struts 52, 52. A plurality of side slots 70, 72, 74 are formed in the deflector 60 in a direction transverse to the axis $L_1$ of the tubular body 12 so as to provide a plurality of sets of mirror image side tines, namely, a pair of upper tines 76, 76, a pair of center tines 78, 78, a pair of lower tines 80, 80, and a pair of bottom tines 82, 82. As an important feature of the present invention, the upper tines 76, 76 and the lower tines 80, 80 are both inclined rearwardly at an angle $\alpha$ of 10° to 30°, preferably 15° to 25°, with respect to an imaginary vertical plane and diverge from the axis $L_1$ of the tubular body 12 in a direction toward the discharge end 16 of the tubular body 12, as best shown in FIG. 6. The inner extremities of the slots 72, 74 have a substantially semicircular shape. The inner extremities of the slots 70, 70 also have a substantially semicircular shape, but have a diameter greater than the width of the remainder of the slots 70, 70. An arcuate notch 84 is formed in the top of the deflector 60 between the upper tines 76, 76. A vertical slot 86 is formed in the bottom of the deflector 60 between the bottom tines 82, 82.

As shown in FIGS. 2 and 3, a generally L-shaped auxiliary deflector 88 is operatively associated with the deflector 60. The auxiliary deflector 88 includes an upright portion 90 fixedly secured to the free end of the cylindrical frame 42 by a pair of screws 92, 92 and located above the primary deflector 60, and a planar canopy portion 94 extending forwardly from the upper end of the upright portion 90. As best shown in FIG. 3, the canopy portion 94 is inclined downwardly at an angle $\beta$ of 1° to 30°, illustratively, 4°, with respect to the axis $L_1$ of the tubular body 12. When the deflector 60 is axially urged out of the frame 42 as shown in FIG. 2, the connection between the upright portion 90 and the canopy portion 94 of the auxiliary deflector 88 is located behind the deflector 60.

Referring back to FIG. 1, the thermally responsive assembly 48 is releasably attached to the open end of the frame 42 so as to normally urge the valve element 36 into its closed position through a retainer 96. The retainer 96 is normally disposed between the thermally responsive assembly 48 and the projection 62. The thermally responsive assembly 48 forms no part of the present invention. Details of the thermally responsive assembly are discussed in Japanese patent publication No. 58-36985. The contents of this publication are incorporated herein by reference.

Figure 7:
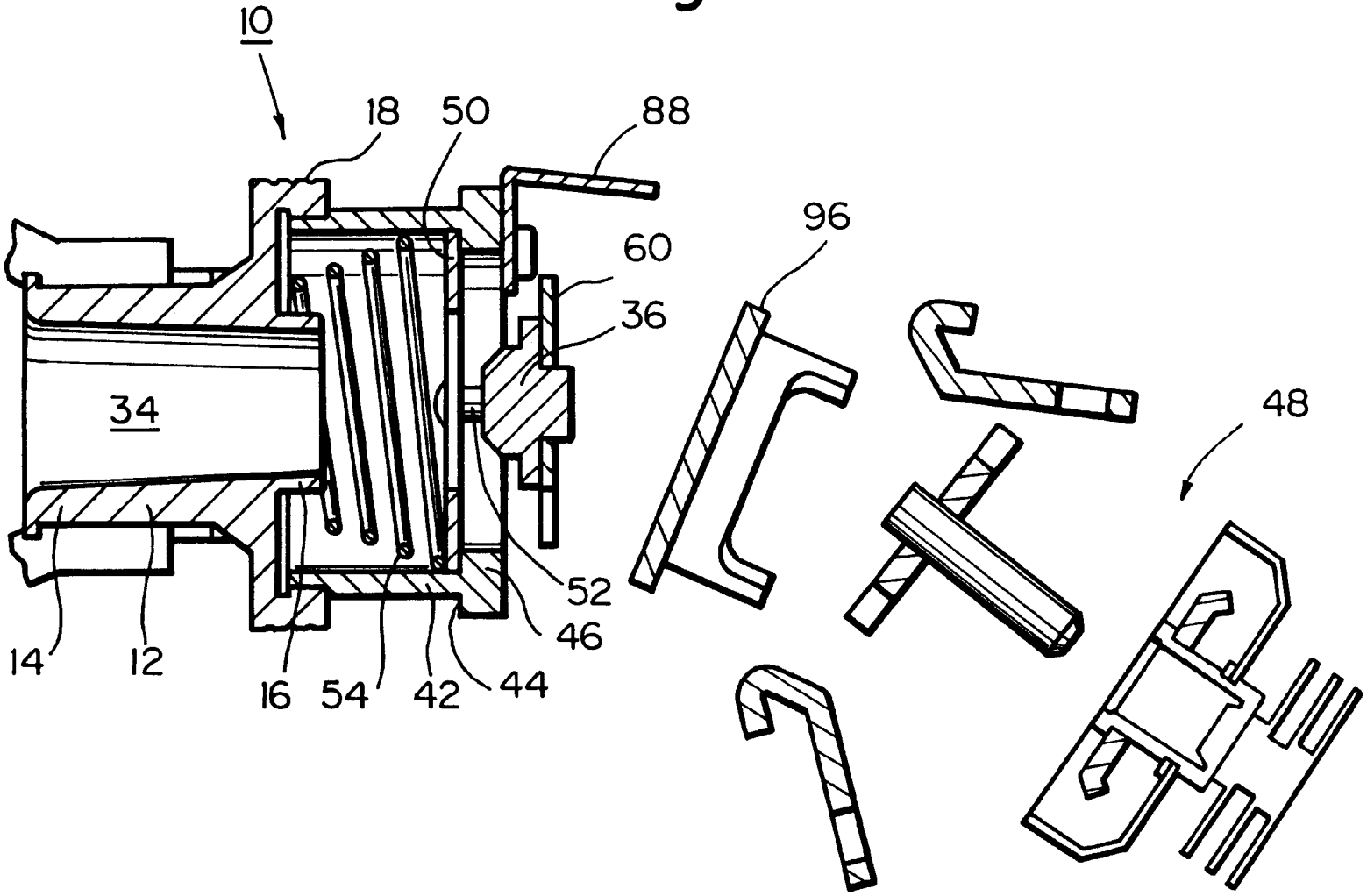
FIG. 7 is a view similar to that of FIG. 1, but showing the manner in which a thermally responsive assembly disintegrates.

When the ambient temperature exceeds a predetermined value, the thermally responsive assembly 48 disintegrates, as shown in FIG. 7. Water or other fire extinguishing liquid flows through the internal passage 34 and is then directed to the valve element 36. The liquid pressure in the internal passage 34 causes the valve element 36 to be unseated from the discharge end 16 of the tubular body 12 and urged out of the frame 42 while the deflector 60 is being axially guided by the struts 52, 52. At this time, the ring 50 is urged toward the open end of the frame 42 under the action of the compression spring 54. Axial movement of the ring 50 within the frame 42 is stopped when the ring 50 abuts the inner flange 46.

Figure 8:
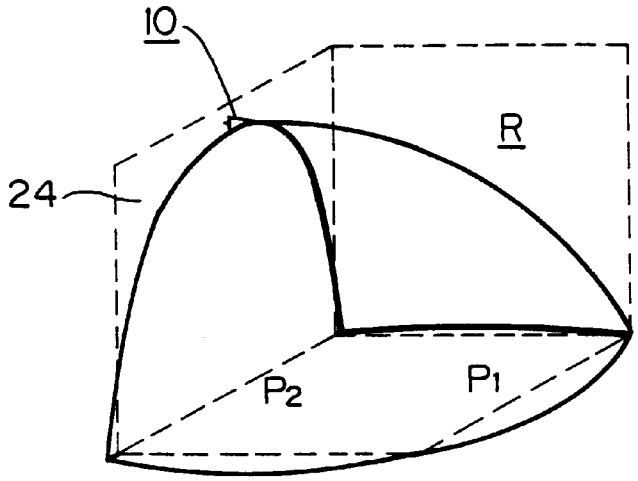
FIG. 8 is a schematic view showing the manner in which fire extinguishing liquid is distributed from the sprinkler head when the deflector tines are rearwardly angled at an angle of 10° to 30°.
Figure 11:
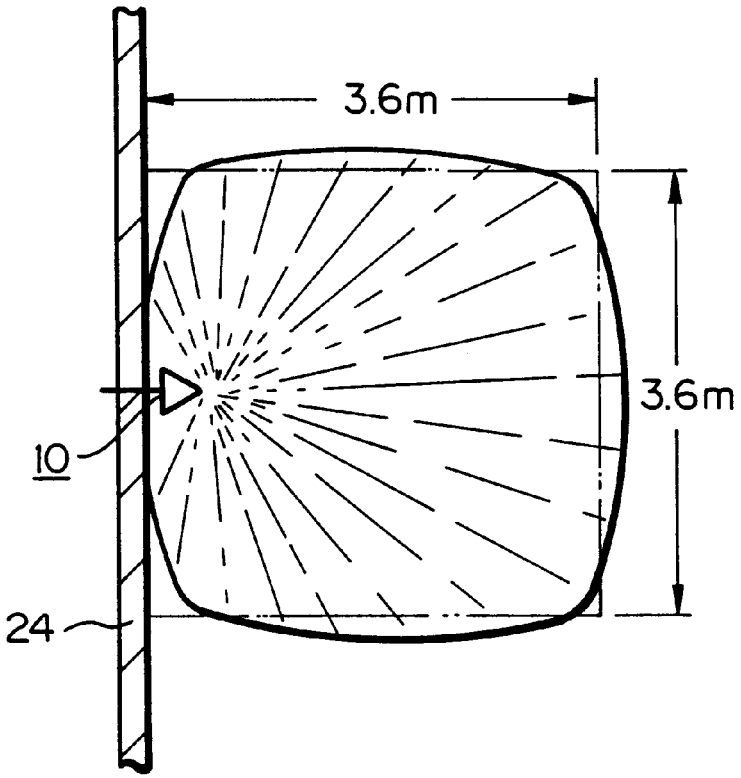
FIG. 11 is a schematic view showing the manner in which fire extinguishing liquid is optimally distributed over the area to be protected with the use of the sprinkler head of the present invention.
Figure 12:
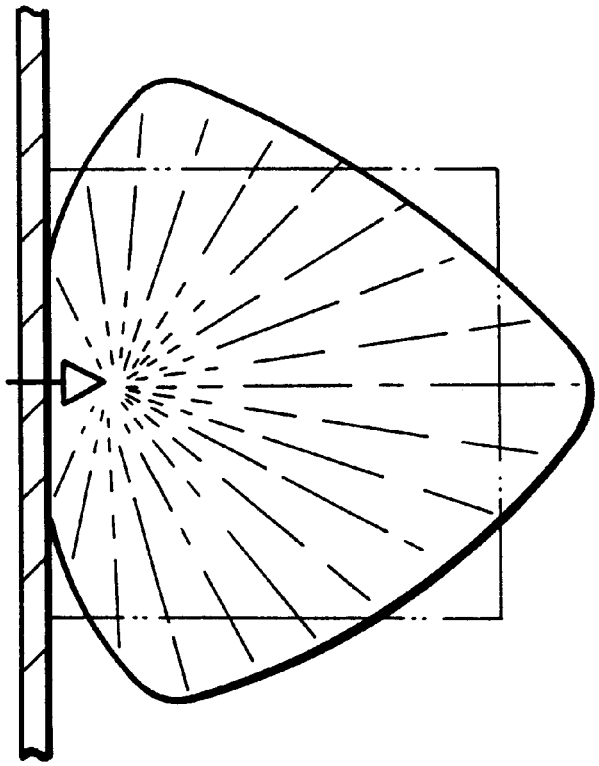
Fig. 12 PRIOR ART
FIG. 12 is a schematic view showing the manner in which fire extinguishing liquid is distributed with the use of a conventional deflector.

The liquid under pressure is directed against the primary deflector 60 and the auxiliary deflector 88 for distribution over the area (e.g. 3.6 m×3.6 m) to be protected. More specifically, the canopy portion 94 of the auxiliary deflector 88 serves to direct liquid which passes through the arcuate notch 84 toward the opposing wall or to a remote region $P_1$ of the area to be protected as shown in FIG. 8. As discussed above, the canopy portion 94 is downwardly inclined at an angle β in the range from 1° to 30° with respect to the axis $L_1$ of the tubular body 12. This arrangement assures optimum distribution across the remote region $P_1$ of the area to be protected as shown in FIG. 8 as well as FIG. 11.

Figure 9:
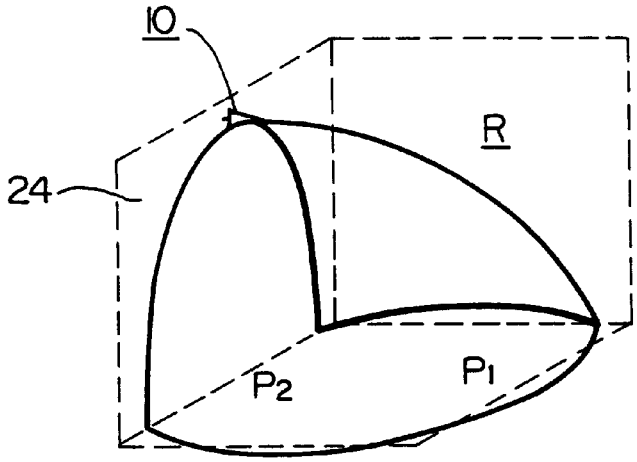
FIG. 9 is a view similar to FIG. 8, but showing the manner in which fire extinguishing liquid is distributed from the sprinkler head if the deflector tines are rearwardly angled at an angle of less than 10°.
Figure 10:
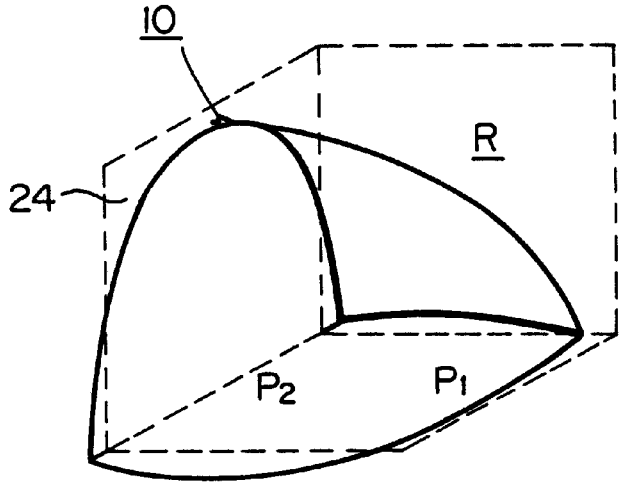
FIG. 10 is a view similar to FIG. 8, but showing the manner in which fire extinguishing liquid is distributed from the sprinkler head if the deflector tines are rearwardly angled at an angle of greater than 30°.
Figure 14:
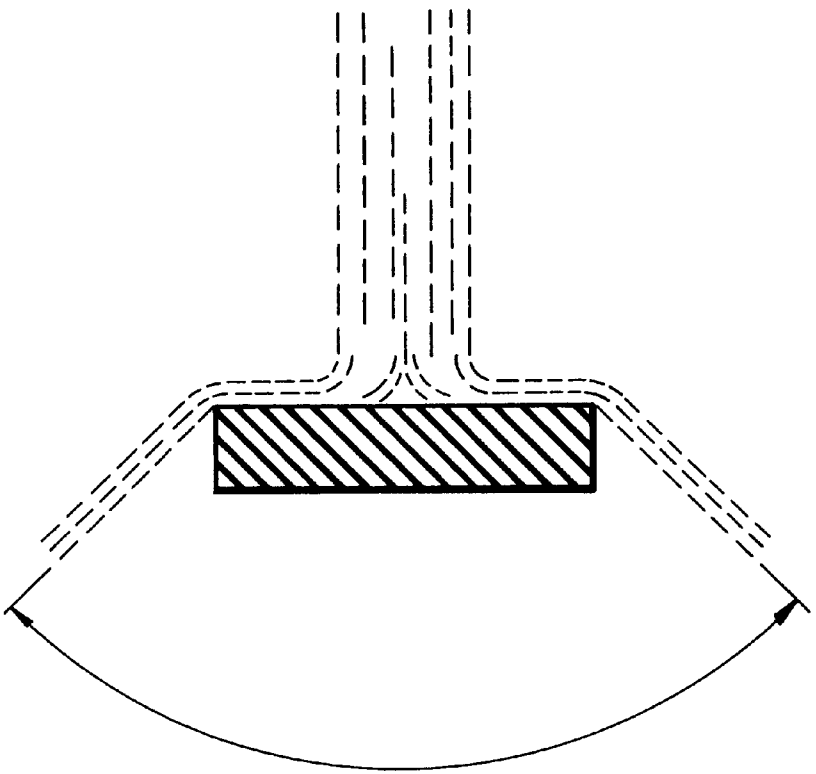
FIG. 14 is a view similar to that of FIG. 13, but showing the manner in which liquid is distributed with the use of a planar deflector.
Figure 13:
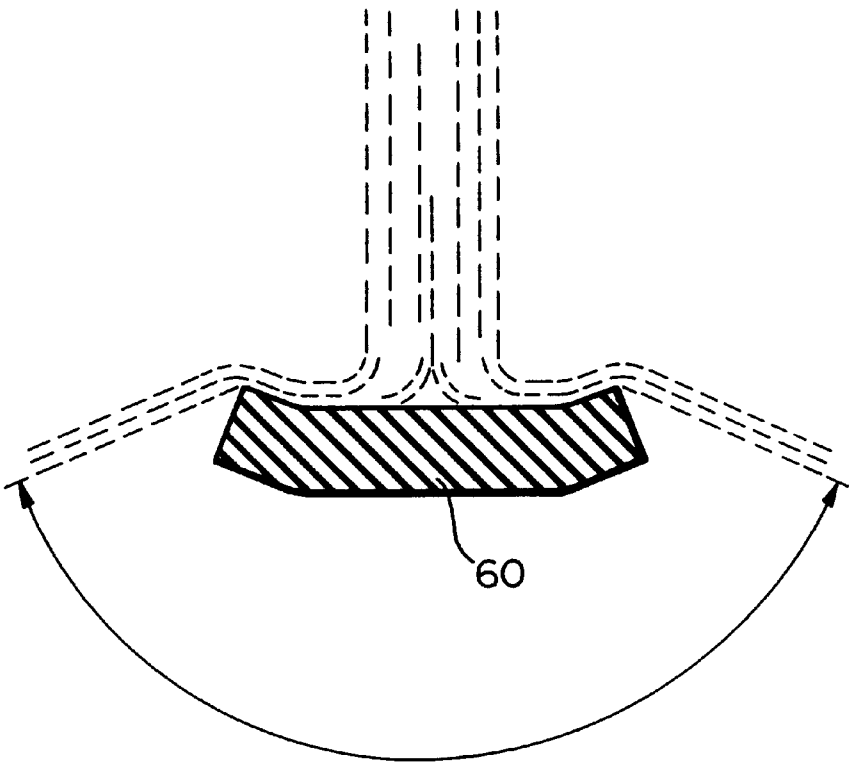
FIG. 13 is a schematic top plan view of the deflector shown in FIG. 4, showing the manner in which liquid is directed against the sidewall of the room as well as across the region beneath the sprinkler head.

The tines 76, 78, 80, 82, in turn, serve to direct liquid against the sidewall 24 and across a region $P_2$ beneath the sprinkler head 10. As schematically shown in FIG. 13, the rearwardly angled diverging tines 76, 80 allow the liquid to be distributed uniformly across the region $P_2$ as compared to a planer deflector as shown in FIG. 14. As previously discussed, the tines 76, 80 are rearwardly inclined at an angle α in the range from 10° to 30°. Tests have showed that if the angle of inclination of the tines 76, 80 is less than 10°, the deflector produces an undesirably narrower pattern of liquid in the region $P_2$ as shown in FIG. 9, whereas if the angle of inclination of the tines 76, 80 is greater than 30°, the deflector produces a wastefully wider pattern of liquid in the region $P_2$ as shown in FIG. 10.

Figure 15:
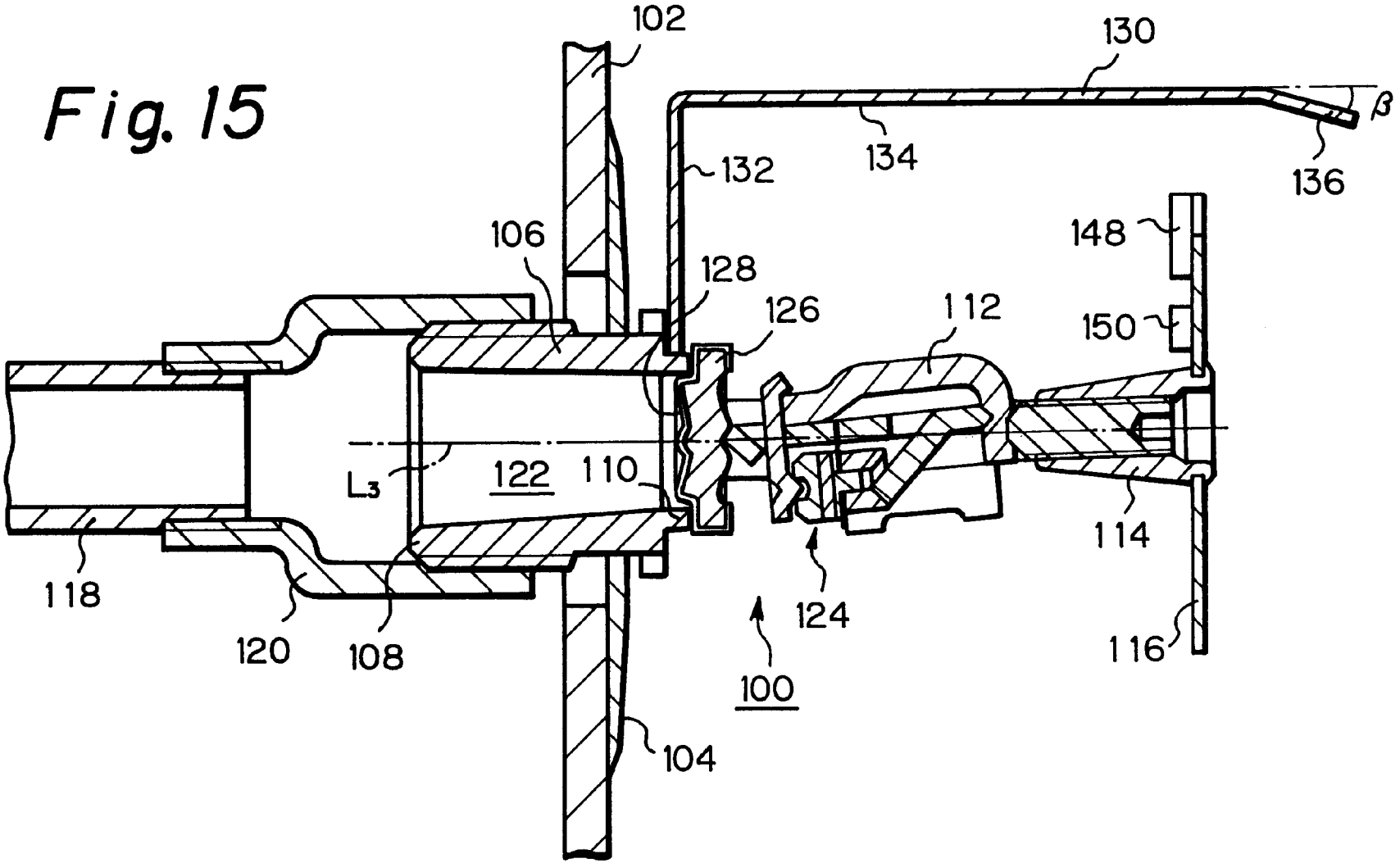
FIG. 15 is a longitudinal sectional view of a frame-yoke type horizontal sidewall sprinkler head made according to another embodiment of the present invention and mounted on one sidewall of a room.
Figure 16:
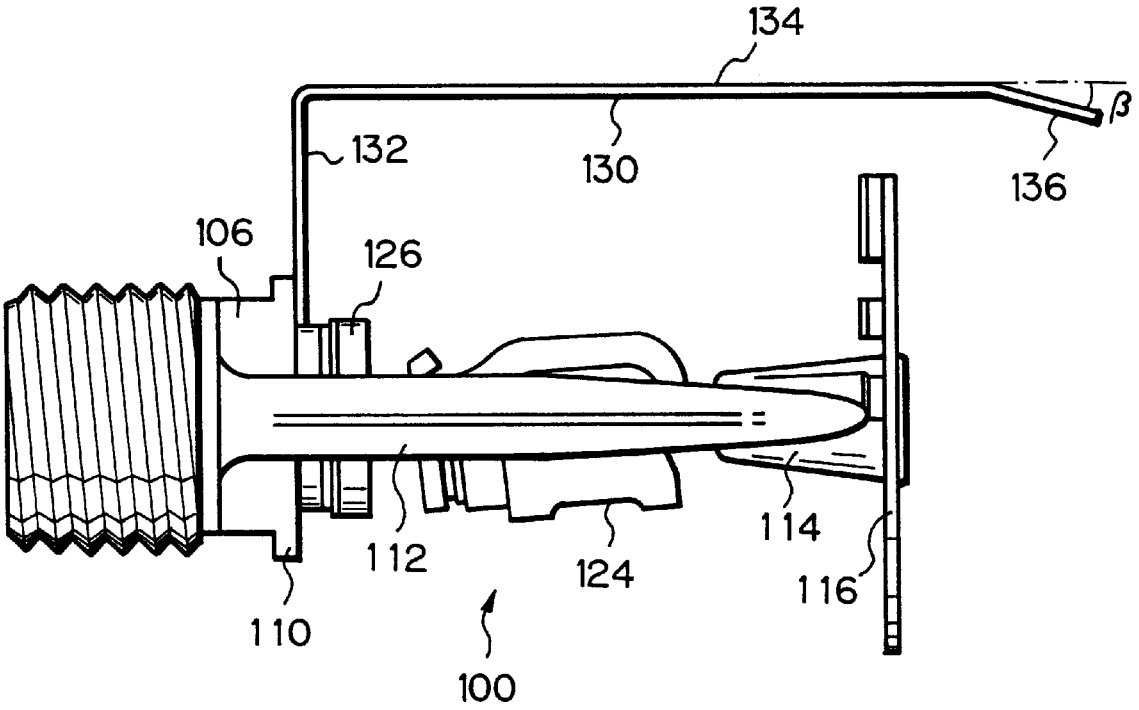
FIG. 16 is a side view of the frame-yoke type horizontal sidewall sprinkler head shown in FIG. 15.

Referring next to FIGS. 15 and 16, there is illustrated a frame-yoke type horizontal sidewall sprinkler head made according to another embodiment of the present invention and generally designated at 100. Illustratively, the sprinkler head 100 is installed near the top of a vertical sidewall 102 of a room through a suitable mount 104.

The sprinkler head 100 includes an externally threaded tubular body 106 with an inlet end 108 and a discharge end 110, and a frame 112 extending forwardly from near the discharge end 110 of the tubular body 106. One end of the frame 112, remote from the discharge end 110 of the tubular body 106, terminates at a conical boss 114. A generally rectangular deflector 116 is fixedly secured to the boss 114. The inlet end 108 of the tubular body 106 is fluidly connected to a water supply line 118 through an internally threaded fitting 120. The tubular body 106 includes an internal passage 122 which extends between the inlet end 108 and the discharge end 110 of the tubular body 106 and is communicated with the water supply line 118. The tubular body 106 has a generally horizontally extending axis $L_3$ which extends centrally through the internal passage 122. A thermally sensitive or responsive assembly is generally indicated at 124 is normally held between the boss 114 and a valve element 126 to urge the valve element 126 against the discharge end 110 of the tubular body 106. The thermally responsive assembly 124 forms no part of the present invention. Details of the thermally responsive assembly are discussed in Japanese utility model publication No. 42-16553. The contents of this publication are incorporated herein by reference. A gasket 128 is attached to the valve element 126 to tightly seal the discharge end 110 of the tubular body 106.

An auxiliary deflector 130 includes an upright portion 132 secured to the discharge end 110 of the tubular body 106, and a substantially planer canopy portion 134 extending forwardly from the upper end of the upright portion 132 in a direction substantially parallel to the axis $L_3$ of the tubular body 106. The canopy portion 134 has a downwardly bent end 136 located forwardly of the primary deflector 116. The bent end 136 of the canopy portion 134 is inclined downwardly at an angle β in the range from 1° to 30°, illustratively 4°, with respect to the axis $L_3$ of the tubular body 106, as in the previous embodiment.

Figure 17:
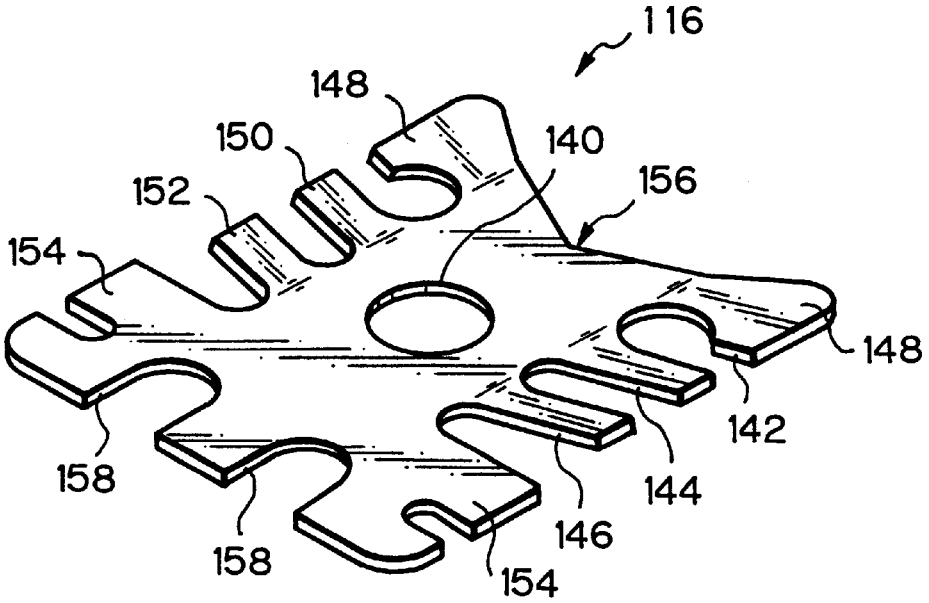
FIG. 17 is a perspective view of a deflector incorporated in the sprinkler head shown in FIG. 15.

Referring to FIG. 17, the primary deflector 116 is laterally symmetrical and is in the form of a generally rectangular plate. The deflector 116 includes a central opening 140 through which the deflector 116 is snugly fitted over the front end of the boss 114. A plurality of pairs of side slots 142, 144, 146 are formed in the deflector 116 so as to provide a plurality of sets of mirror image side tines 148, 150, 152, 154, namely, the top tines 148, 148, the first intermediate tines 150, 150, the second intermediate tines 152, 152 and the bottom tines 154, 154. A substantially triangular notch 156 is formed in the top of the deflector 116 between the top tines 148, 148. A pair of vertical slots 158, 158 are formed in the bottom of the deflector 116 between the bottom tines 154, 154. As in the previous embodiment, the top tines 148, 148, the first intermediate tines 150, 150 and the second intermediate tines 152, 152 are bent rearwardly at an angle α in the range from 10° to 30°, preferably 15° to 25°, with respect to an imaginary vertical plane, and diverge from the axis $L_3$ of the tubular body 106 in a direction toward the discharge end 110 of the tubular body 106.

In use, when the ambient temperature exceeds a predetermined value, the thermally responsive assembly 124 disintegrates. Water or other fire extinguishing liquid flows through the internal passage 122 and is then directed to the valve element 126. The liquid pressure in the internal passage 126 causes the valve element 126 to be disengaged from the discharge end 110 of the tubular body 106.

With the discharge end 110 of the tubular body 106 opened, the liquid under pressure is directed against the primary deflector 116 and the auxiliary deflector 130 for distribution over the area (e.g. 3.6 m×3.6 m) to be protected. More specifically, the bent end 136 of the canopy portion 130 of the auxiliary deflector 130 serves to direct liquid which passes through the triangular notch 156 toward the opposing wall or to the remote region of the area to be protected. As discussed above, the bent end 136 of the canopy portion 130 is downwardly inclined at an angle β in the range from 1° to 30° with respect to the axis $L_3$ of the tubular body 106. This arrangement assures optimum distribution across the remote region of the area to be protected.

The tines 148, 150, 152, 154, in turn, serve to direct liquid against the vertical sidewall 102 and across the region beneath the sprinkler head 100. The rearwardly angled diverging tines 148, 150, 152 allow the liquid to be distributed uniformly across the region beneath the sprinkler head 100. Water distribution tests have showed that if the angle of inclination of the tines 148, 150, 152 is less than 10°, the deflector 116 produces an undesirably narrower pattern of liquid in the region beneath the sprinkler head 100, whereas if the angle of inclination of the tines 148, 150, 152 is greater than 30°, the deflector 116 produces a wastefully wider pattern of liquid in the remote region of the area to be protected.

The present invention has been described with respect to its preferred embodiments. It is to be understood that various modifications and changes may be made without departing from the scope of the invention as defined by the appended claims.

What is claimed is:

1. A horizontal sidewall sprinkler head, comprising:

a tubular body having an inlet end adapted to be connected to a source of fire extinguishing liquid and a discharge end, said tubular body including an internal passage extending axially therethrough, said tubular body having an axis extending generally centrally through said internal passage; and a deflector supported by said tubular body, said deflector including a plurality of sets of side tines extending in a direction transverse to the axis of said tubular body, and at least one set of tines of said plurality of sets of side tines being sidewardly and rearwardly angled and diverging from the axis of said tubular body in a direction toward said discharge end of said tubular body.

2. The horizontal sidewall sprinkler head of claim 1, wherein said deflector has a top, a bottom, sides, and a flat main part, and said at least one set of tines are sidewardly and rearwardly angled from the sides of said main part as if rearwardly bent from said main part about a vertical axis.

3. The horizontal sidewall sprinkler head of claim 1, wherein said deflector has a top, a bottom, sides, and a flat vertical main part, and said at least one set of tines are sidewardly and rearwardly angled from the sides of said main part so as to lie in a vertical plane.

4. A horizontal sidewall sprinkler head according to claim 1, wherein said at least one set of tines are rearwardly bent at an angle of 10° to 30°.

5. A horizontal sidewall sprinkler head according to claim 1, wherein said at least one set of tines are rearwardly bent at an angle of 15° to 25°.

6. A horizontal sidewall sprinkler head according to claim 1, wherein said deflector has a top and a bottom, and said plurality of sets of tines are located between said top and said bottom thereof, further comprising an auxiliary deflector secured to said tubular body and including a canopy portion located above said deflector and downwardly angled with respect to the axis of said tubular body, said deflector having at its top a notch through which the fire extinguishing liquid flows and is directed to said auxiliary deflector.

7. A horizontal sidewall sprinkler head according to claim 6, wherein said canopy portion of said auxiliary deflector is inclined downwardly at an angle of 1° to 30° with respect to the axis of said tubular body.

8. A horizontal sidewall sprinkler head according to claim 6, wherein said notch has an arcuate shape.

9. A horizontal sidewall sprinkler head according to claim 6, wherein said notch has a triangular shape.

10. A horizontal sidewall sprinkler head according to claim 1, wherein said deflector has a top and a bottom, and said plurality of sets of tines are located between said top and said bottom thereof, further comprising an auxiliary deflector operatively associated with said deflector, said auxiliary deflector including an upright portion having one end secured to said tubular body and an other end, and a canopy portion located above said deflector and extending forwardly from said other end of said upright portion, said canopy portion having a downwardly bent end, said deflector having at its top a notch through which the fire extinguishing liquid flows and is directed to said bent end of said auxiliary deflector.

11. A horizontal sidewall sprinkler head according to claim 10, wherein said bent end of said canopy portion is inclined downwardly at an angle of 1° to 30° with respect to the axis of said tubular body.

12. A horizontal sidewall sprinkler head according to claim 10, wherein said bent end of said canopy portion is located forwardly of said deflector.

13. A horizontal sidewall sprinkler head according to claim 10, wherein said top notch has an arcuate shape.

14. A horizontal sidewall sprinkler head according to claim 10, wherein said top notch has a triangular shape.

15. A horizontal sidewall sprinkler head according to claim 1, further comprising a valve element normally seated on said discharge end of said tubular body, and a thermally responsive assembly positioned to normally urge said valve element against said discharge end of said tubular body, said thermally responsive assembly being capable of disintegration when an ambient temperature exceeds a predetermined value, whereby said valve element is disengaged from said discharge end of said tubular body to permit the fire extinguishing liquid to be directed to said deflector.

16. A deflector adapted for use in a horizontal sidewall sprinkler head including a tubular body with an inlet end and a discharge end, said deflector having a top, a bottom, sides, a front and a rear, and said deflector comprising a plurality of sets of side tines, at least one set of side tines of said plurality of sets of side tines being sidewardly and rearwardly angled such that when said deflector is used with the tubular body said at least one set of tines diverges toward the discharge end of the tubular body.

17. The deflector of claim 16, wherein said at least one set of side tines are sidewardly and rearwardly bent from a planar main body of said deflector.

18. The deflector of claim 16, wherein said deflector has a top, a bottom, sides, and a flat main part, and said at least one set of tines are sidewardly and rearwardly angled from the sides of said main part as if rearwardly bent from said main part about a vertical axis.

19. The deflector of claim 16, wherein said deflector has a top, a bottom, sides, and a flat vertical main part, and said at least one set of tines are sidewardly and rearwardly angled from the sides of said main part so as to lie in a vertical plane.

20. A deflector according to claim 16, wherein said at least one set of side tines are bent rearwardly at an angle of 10° to 30°.

21. A deflector according to claim 16, wherein said at least one set of side tines are bent rearwardly at an angle of 15° to 25°.

22. A deflector according to claim 16, wherein said deflector is generally circular in shape, said deflector further comprising a notch located at said top thereof and having an arcuate shape.

23. A deflector according to claim 16, wherein said deflector is generally rectangular in shape, said deflector further comprising a notch located at said top thereof and having a triangular shape.

* * * * *